United States Patent [19]

Toder

[11] 4,336,757

[45] Jun. 29, 1982

[54] TRACK SWITCH

[76] Inventor: Ellis I. Toder, 341 Militia Hill Rd., Fort Washington, Pa. 19034

[21] Appl. No.: 78,247

[22] Filed: Sep. 24, 1979

Related U.S. Application Data

[62] Division of Ser. No. 881,394, Feb. 27, 1978, Pat. No. 4,229,857.

[51] Int. Cl.[3] ..... E01B 7/08

[52] U.S. Cl. ..... 104/102; 104/96

[58] Field of Search ..... 104/96, 102, 103, 130, 104/195; 16/87.4 R, 93 R, 93 D, 94 R, 94 D, 95 R, 95 D, 96 R, 96 D; 160/330; 236/454

[56] References Cited

U.S. PATENT DOCUMENTS

| | | | |
|---|---|---|---|
| 706,139 | 8/1902 | Werner | 104/102 |
| 2,138,962 | 12/1938 | Forker, Jr. | 104/102 |
| 2,564,953 | 8/1951 | Bopp | 104/103 |
| 3,358,319 | 12/1967 | Hillenbrand et al. | 104/96 |
| 3,464,364 | 9/1969 | Dehne | 104/96 |
| 3,735,709 | 5/1973 | Matsumoto et al. | 104/130 |
| 3,879,799 | 4/1975 | Williams | 16/95 R |
| 4,141,106 | 2/1979 | Dixon | 16/95 R |

FOREIGN PATENT DOCUMENTS

| | | | |
|---|---|---|---|
| 2218373 | 10/1973 | Fed. Rep. of Germany | 104/102 |

*Primary Examiner*—Joseph F. Peters, Jr.
*Assistant Examiner*—Ross Weaver
*Attorney, Agent, or Firm*—Walter B. Udell

[57] ABSTRACT

A hospital curtain track system utilizing a track switch which permits the use of a single privacy curtain selectively for each of a pair of adjacent bed cubicles. One track switch unit between each two bed environment splices directly with the cubicle track and eliminates extra connecting parts including one complete track leg resulting in minimal installation time and expense. The switch utilizes a pull-chain actuated toggle for shifting a horizontally shiftable switch section into alignment with the desired curtain track.

7 Claims, 5 Drawing Figures

TRACK SWITCH

This invention relates to privacy curtain track systems and more particularly to a hospital track system utilizing a track switch which permits the use of a single privacy curtain selectively for each of a pair of adjacent bed cubicles, and is a division of copending application Ser. No. 881,394 filed Feb. 27, 1978, now U.S. Pat. No. 4,229,857.

The switch is of two types, one type being usable in a recessed system installable flush with the underside of and as an integral part of an original ceiling installation, and another type being surface mounted installable upward against the underside of an existing ceiling. One track switch unit between each two bed environment splices directly with the cubicle track and eliminates extra connecting parts including one complete track leg resulting in minimal installation time and expense. The switch utilizes a pull-chain actuated toggle for shifting a horizontally shiftable switch section into alignment with the desired curtain track.

A primary object of the invention is to provide a novel curtain track system which requires only one curtain to provide privacy for a plurality of hospital beds.

Another object of the invention is to provide a novel curtain track system as aforesaid which utilizes a manually actuatable track switch to selectively direct a privacy curtain from one track to another.

In the several figures, like elements are denoted by like reference characters.

Figure 1:
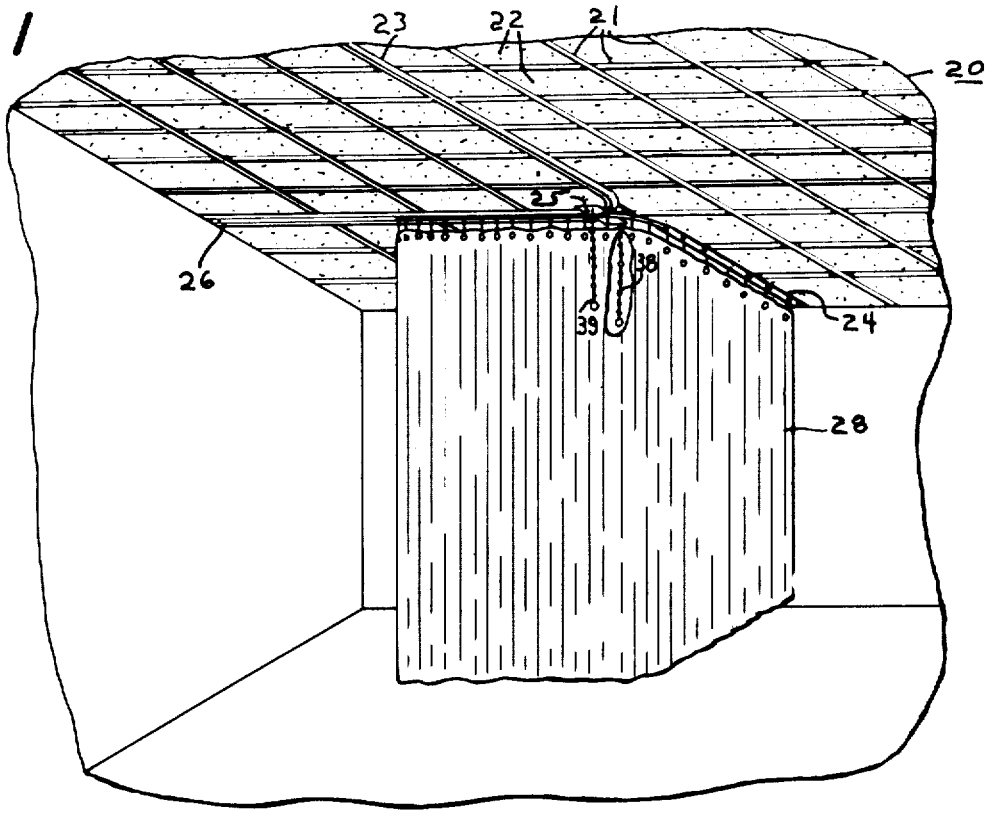
FIG. 1 is an isometric view of the novel ceiling recessed curtain track system according to the invention.
Figure 2:
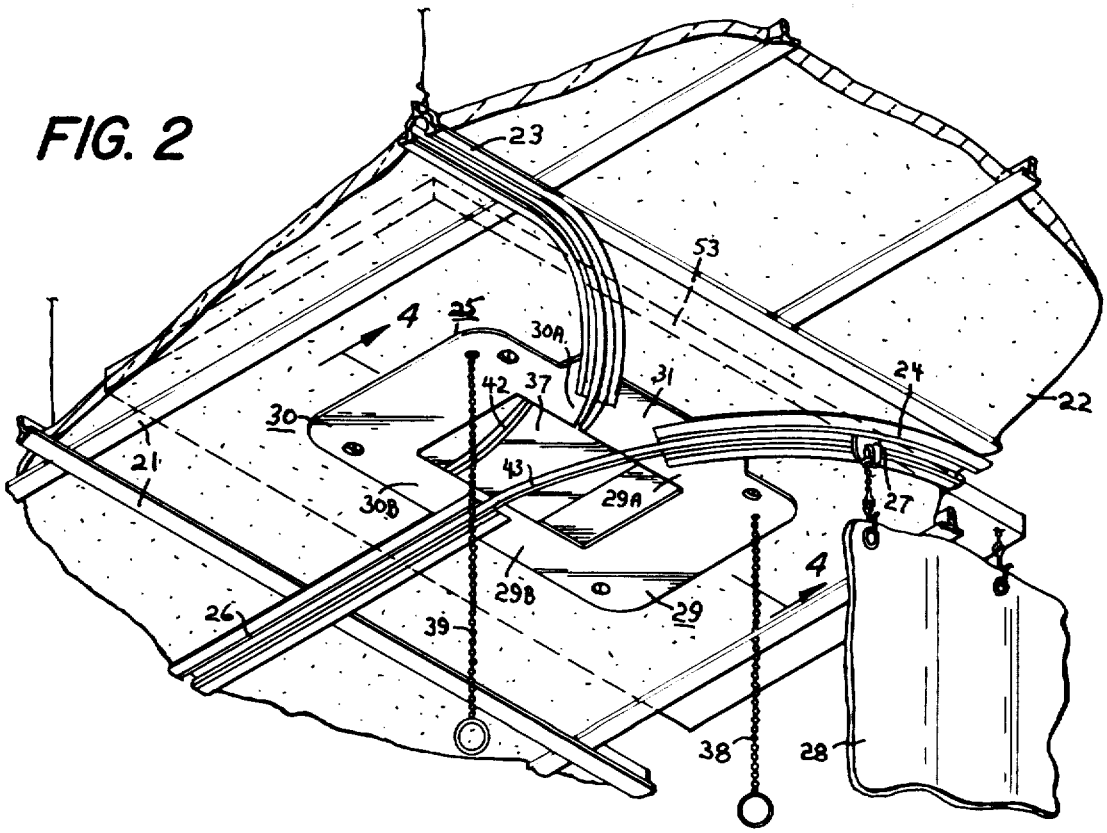
FIG. 2 is a fragmentary isometric view of the curtain track system in the region of the track switch.

Referring now to the drawings, and first to FIGS. 1 and 2, there is observed a room, which typically could be a hospital room, having a suspended ceiling 20 consisting of a plurality of the usual T-bar supports, designated generally as 21, which support a plurality of ceiling panels 22. In place of one of the T-bars 21 are a pair of curtain tracks 23 and 24 which are flush mounted in the ceiling and function not only as curtain tracks but also as an integral part of the suspended ceiling support grid. The two curtain tracks 23 and 24 are shown as co-linearly alined, and as they approach each other curve out of alinement and inward into engagement with a track switch 25. A third curtain track 26 extends outward from the track switch 25 substantially orthogonally to the running length of the curtain tracks 23 and 24, and also forms part of the ceiling support grid. Suspended from the track system by carriers 27 is a curtain 28 which, as seen in FIG. 1, forms a cubicle when extended along the tracks 24 and 26 through the switch 25, and which forms a second cubicle, not shown, when the curtain is extended along tracks 23 and 26 through the switch 25.

Figure 3:
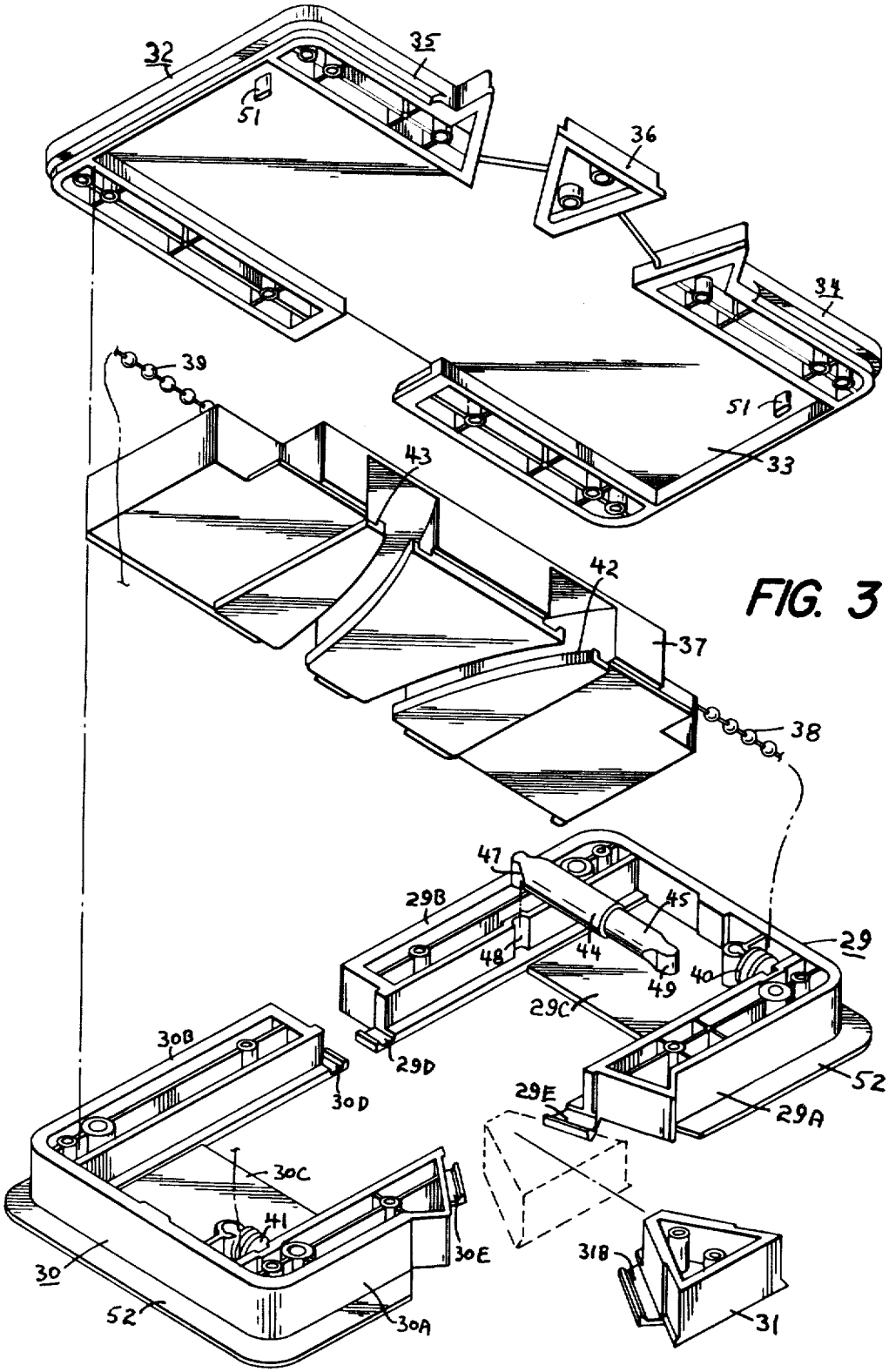
FIG. 3 is an exploded isometric view of the track switch.

As best seen in FIGS. 2 and 3, the track switch 25 is seen to have a pair of symmetrical bottom or lower outer sections 29 and 30 of generally C-shape or U-shape, and a generally truncated triangularly shaped section 31 spaced between legs 29A and 30A of the outer sections 29 and 30. As best seen in FIG. 3, the switch has a top section 32 having a top closure plate 33 from which depend a pair of outer sections 34 and 35 which are congruent with and matingly overlie the bottom outer sections 29 and 30 respectively, and also has a top triangular section 36 which congruently matingly overlies the bottom triangular section 31. A generally rectangular dual track switch slider 37 is held slidably captive between the top plate 33 and the bottom plates 29C and 30C of the lower outer sections 29 and 30. Secured to the slider 37 are a pair of ball chain pulls 38 and 39, the chain 38 being trained around pulley 40 and extending downward through an aperture in the bottom outer section 29, while the chain 39 is similarly trained around a pulley 41 and extends downward through an aperture in the bottom outer section 30.

Figure 5:
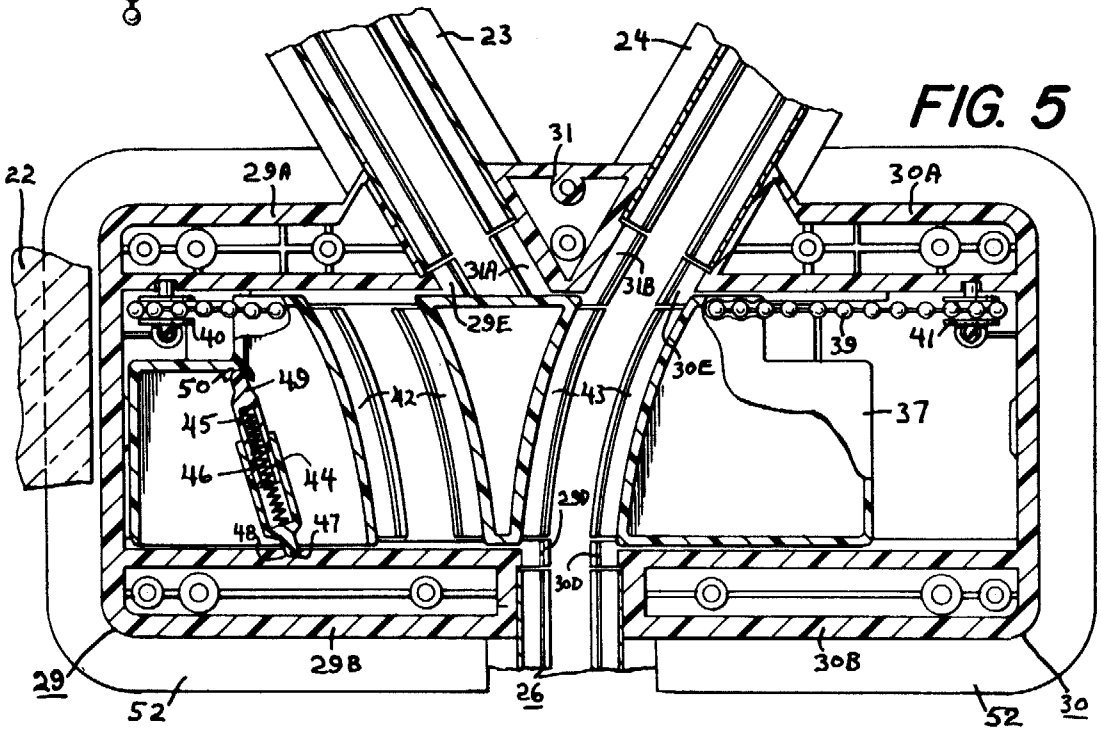
FIG. 5 is a horizontal sectional view through the track switch as would be seen when viewed along lines 5—5 of FIG. 4.

As best seen in FIG. 2, the legs 29B and 30B of the bottom outer sections 29 and 30 form an opening into which the end of the common track 26 fits precisely and accurately, this opening also being shown in FIG. 5 with a portion of the end of track 26 disposed therein with the actual tracks 56 on which the wheels of the curtain carriers 27 ride being alined with track portions 29D and 30D formed respectively on the ends of legs 29B and 30B of the bottom outer sections 29 and 30. In a similar manner, a pair of branch track openings to receive the ends of the tracks 23 and 24 are formed between the ends of legs 29A and 30A of the bottom outer sections 29 and 30 and the bottom triangular section 31. Track sections 29E and 31A form continuations of the carrier tracks of curtain track 23, while track portions 30E and 31B form the track continuations for the track portions of curtain track 24.

The switch slider 37 is formed with a pair of curved track sections 42 and 43 which respectively connect the common track opening for track 26 with the branch track openings for tracks 23 and 24 as a function of the position of the switch slider 37. As shown in FIG. 5 of the drawings, with one end of the switch slider against the end wall of bottom outer section 29, the curved switch slider track section 43 forms a continuous smooth track connecting section between branch track 24 and common track 26. When the switch slider 37 is shifted to the right so that the end disposed within the bottom outer section 30 is stopped by the end wall of section 30, then switch slider track section 42 forms a continuous track connection between track 23 and common track 26. Shifting of the switch slider 37 from one switch position to the other is accomplished by pulling downward on the ball chain pulls 38 and 39, downward pull on chain 38 causing the switch to assume the condition shown on FIG. 5, whereas pulling downward on ball chain 39 causes the switch slider 37 to move laterally and connect tracks 23 and 26 by means of the curved track section 42.

The switch slider 37 remains in stable switch position because of the over-center toggling action of a spring toggle formed by an outer cylindrical telescopic section 44 and an inner section 45 with a compression spring 46 held captive within and between the inner and outer telescopically engaged toggle cylindrical sections 44 and 45. The free end of outer cylinder 44 is formed in the shape of a semi-circular cylindrical section 47 which seats in pivotal fashion in a semi-circular cylindrical socket 48 molded on the inner surface of leg 29B of bottom outer section 29. Similarly, the free end of toggle inner telescopic section 45 is similarly formed with a semi-circular cylindrical end section 49 which fits pivotally smoothly into a semi-circular cylindrical socket 50 formed on the inside of the switch slider 37, as best seen in the showing of FIG. 5. The pivot end 47 is the fixed pivot while the pivot end 49 is the floating pivot, which latter turns within socket 50 and swings over toward the right as the slider 37 moves to the right under the urging of pull chain 39, the pivot end 47 pivoting within the socket 48 but undergoing no translational or shifting movement.

Figure 4:
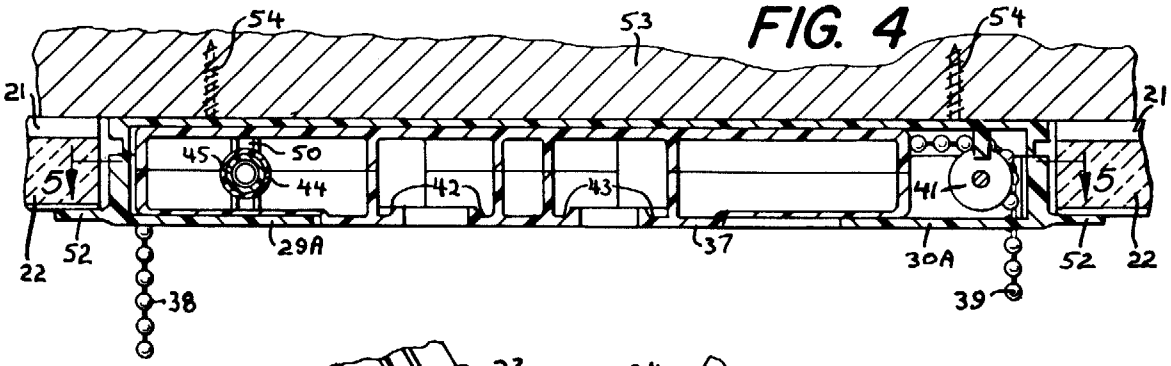
FIG. 4 is a vertical sectional view through the track switch as would be seen when viewed along lines 4—4 of FIG. 2.

The pull chains 38 and 39 are restrained from lateral movement off of their associated pulleys 40 and 41 by being held captive laterally between the side guide posts 51 which depend from the top plate 33 and the adjacent inner edges of the top outer sections 34 and 35. The switch 25 is also provided with a peripherally extending flange 52 which underlies the adjacent parts of the ceiling which have been cut out so that the switch may be upwardly recessed for flush mounting with the ceiling undersurface. A switch support plate is positioned above the switch 25 and overlying a pair of adjacent T-bar supports 21, as best seen in FIGS. 2 and 4, to carry and support the mass of the switch 25 and provide sufficient mechanical support to oppose the downward pull exerted by chains 38 and 39 which actuate the switch mechanism, the support plate being designated as 53, and the switch being shown secured thereto in FIG. 4 by the screws 54. While the switch may be made in any desired fashion, it is illustrated as being formed of molded plastic to provide a minimum weight.

What is claimed to be new and useful is:

1. A track switch for use in a curtain track system of the type comprising first and second branch tracks and a common track, said track switch being adapted for operative coupling to each of said first and second and common tracks, said track switch including, (a) shiftable track means for selectively interconnecting said common track to one of said first and second branch tracks, said shiftable track means comprising first and second separate switch track sections fixedly intercoupled and movable as a unit, said first switch track section being movable into position to interconnect said first branch track to said common track when said actuating means is actuated in a first way, and said second switch track section being movable into position to interconnect said second branch track to said common track when said actuating means is actuated in a second way, (b) actuating means for selectively shifting said shiftable track means to connect said common track as desired to either of said first or second branch tracks, and (c) a hollow switch body having a closed top, a closed bottom having a central aperture, a pair of closed opposite side walls and a pair of opposite end walls intersecuring said top and bottom, one of said pair of end walls having a separate track-end receiving opening for each of said first and second branch tracks and the other of said pair of end walls having a track-end receiving opening for said common track, said shiftable track means comprising a slider unit held captive within said hollow switch body and closing the central aperture in said switch body bottom irrespective of the position of said shiftable track means.

2. A track switch as described in claim 1 wherein said hollow switch body further includes a flange extending peripherally thereabout and outward from the lower edge of the switch body, said flange being adapted to closely underlie the lower surface of a ceiling into which the switch body may be upwardly recessed.

3. A track switch as described in claim 1 wherein said hollow switch body further includes interior fixed track sections positioned to function as continuations of the external branch and common tracks and provide a smooth track continuation between said external tracks and said shiftable track means first and second track sections.

4. A track switch as described in claim 1 wherein said actuating means for selectively shifting said shiftable track means comprises a resilient toggle coupled at one point to said hollow switch body and coupled at another point to said slider unit.

5. A track switch as described in claim 3 wherein each said switch body track-end receiving opening has received therein a track section comprising in combination (a) a pair of horizontal longitudinally extending parallel spaced apart tracks, and (b) a pair of upstanding sidewalls interconnected with each other at an elevation above the level of said pair of tracks, said switch body track-end receiving opening being formed in cross-section with lands and openings to interfit with and close fittingly receive thereinto at least portions of the ends of said track section tracks and sidewalls, with said tracks aligned with the said switch body interior fixed track sections.

6. A track switch as described in claim 3 wherein said actuating means for selectively shifting said shiftable track means comprises a resilient toggle coupled at one point to said hollow switch body and coupled at another point to said slider unit.

7. A track switch and tracks sections as described in claim 5 wherein each said track section further includes a longitudinally extending horizontal flange extending laterally outward from each of said pair of parallel spaced apart tracks, said flanges extending laterally in opposite directions outward away from one another and also engagingly interfitting with lands and recesses formed in said switch body at said switch body track-end receiving openings.

* * * * *